US009651291B2

(12) United States Patent
Kim

(10) Patent No.: US 9,651,291 B2
(45) Date of Patent: May 16, 2017

(54) TWISTING MECHANISM FOR SEPARATING ICE BLOCKS FROM THE ICE MAKING TRAY

(71) Applicant: Dongbu Daewoo Electronics Corporation, Seoul (KR)

(72) Inventor: Byung Soo Kim, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 275 days.

(21) Appl. No.: 14/187,152

(22) Filed: Feb. 21, 2014

(65) Prior Publication Data

US 2015/0176883 A1 Jun. 25, 2015

(30) Foreign Application Priority Data

Dec. 24, 2013 (KR) ..... 10-2013-0162250

(51) Int. Cl.

| | |
|---|---|
| ***F25C 5/18*** | (2006.01) |
| ***F25C 5/06*** | (2006.01) |
| ***F25C 5/04*** | (2006.01) |
| ***F25C 5/00*** | (2006.01) |

(52) U.S. Cl.
CPC ..... *F25C 5/04* (2013.01); *F25C 5/005* (2013.01); *F25C 2305/022* (2013.01)

(58) Field of Classification Search
CPC ..... F25C 2305/022
USPC ..... 62/72, 344
See application file for complete search history.

(56) References Cited

U.S. PATENT DOCUMENTS

| | | | | |
|---|---|---|---|---|
| 7,841,203 | B2 * | 11/2010 | Yoon | F25C 1/04 249/118 |
| 8,707,725 | B2 * | 4/2014 | Camacho Velazquez | F25C 1/225 62/340 |
| 2010/0147011 | A1 * | 6/2010 | Kang | F25C 1/04 62/344 |
| 2011/0192175 | A1 * | 8/2011 | Kuratani | F25C 1/08 62/72 |

FOREIGN PATENT DOCUMENTS

| | | |
|---|---|---|
| CN | 101451782 | 6/2009 |
| KR | 10-2008-0078558 | 2/2008 |
| KR | 10-2009-0125318 | 12/2009 |
| KR | 10-2012-0018285 | 9/2011 |
| KR | 10-2012-0017491 | 2/2012 |

* cited by examiner

*Primary Examiner* — Allen Flanigan
*Assistant Examiner* — Filip Zec

(57) ABSTRACT

Disclosed are an ice maker and a refrigerator including the ice maker. An exemplary ice making tray of the ice maker or refrigerator includes an ice separating protrusion that extends outwardly from one surface. The refrigerator includes ice separating levers connected by hinges to the tray housing, with the ice making tray therebetween, and at least one of which has a groove that rotates an ice separating protrusion of the ice making tray together while rotating around the hinges, and includes a handle that is longer than the ice making tray, in front of the ice making tray.

5 Claims, 3 Drawing Sheets

TWISTING MECHANISM FOR SEPARATING ICE BLOCKS FROM THE ICE MAKING TRAY

CROSS-REFERENCE TO RELATED APPLICATIONS

This application is claims priority to and the benefit of Korean Patent Application No. 10-2013-0162250, filed on Dec. 24, 2013 with the Korean Intellectual Property Office, the disclosure of which is incorporated herein in its entirety by reference.

TECHNICAL FIELD

The present disclosure relates to an ice maker and a refrigerator having the ice maker. An ice maker is a device installed in a refrigerator to make ice, and the refrigerator is an electronic product for refrigerating and/or freezing food.

BACKGROUND

In general, an ice maker is in a refrigerator. The ice maker includes an ice making tray that provides a plurality of ice making spaces having an angular shape to make angular ice. The ice maker may include an ice separating mechanism for separating ice from the ice making tray after making ice.

The ice maker may include a heater as ice separating mechanism in the related art. This is a method in which the surface of formed ice in the ice making tray is defrosted or wetted, and separated using the heater.

The ice separating mechanism using the heater has a disadvantage in that the heat generated by the heater makes the refrigerator less efficient.

In addition, since the heater is used, the manufacturing cost of the product may increase.

Another ice separating mechanism in the related art applies a twisting movement to both sides of the ice making tray to separate ice.

One ice separating mechanism allows a user to twist an ice making tray to separate ice by using a structure that twists the ice making tray, and another includes an ice making tray that is automatically twisted using a motor to separate ice.

When separating ice by twisting, there is a disadvantage in that ice positioned close to a part of the ice making tray to which twisting is applied is separated well, but ice positioned distantly is not properly separated.

An ice separating mechanism implemented by a twisting method in the related art does not totally twist the ice making tray, but twists only a part, thereby causing deformation in the ice making tray. Also, since only a part of the ice making tray is twisted, the ice making tray also has a problem with rigidity, leading to premature breakage or deformity.

SUMMARY

An ice maker or a refrigerator according to one or more exemplary embodiments of the present disclosure includes an ice separating structure that can totally twist an ice making tray.

The present disclosure includes an ice separating structure that separates ice in the ice making tray regardless of a position of the ice, and has a more rigid structure that is less prone to deformity or breaking.

An ice making tray of an ice maker or a refrigerator according to exemplary embodiment(s) of the present disclosure includes an ice separating protrusion that extends outwardly from one surface.

The ice making tray may be in a tray housing with sides thereof are rotatably supported.

To this end, the tray housing may include a first side wall having a first rotational support and a second side wall having a second rotational support.

A cutout may be on the first side wall of the tray housing to allow the ice separating protrusion of the ice making tray to rotate.

The refrigerator may include: a first rotatable lever connected to the first side wall of the tray housing and having a groove in the ice separating protrusion, and a second rotatable lever connected to the second side wall of the tray housing.

The first and second levers may be connected to each other by a handle in front of the ice making tray. The handle may be rotate both of the first and second rotatable levers.

The groove of the first rotatable lever may comprise a slot to allow the ice separating protrusion to rotate around the first rotational support.

The ice separating protrusion of the ice making tray may extend downwardly from one side wall of the ice making tray, and may extend outwardly from the one side wall.

The ice separating protrusion of the ice making tray may be behind the first rotational support.

The tray housing may include a first hinge connected with the first lever below the first rotational support on the first side wall, and the groove of the first lever may be behind the first lever hinge.

The ice making tray may include a first rotating protrusion which protrudes or extends outwardly from the one side wall and a second rotating protrusion which protrudes or extends outwardly from the other side wall, and the first rotational support of the tray housing may have a shape in which the first rotational support houses the first rotating protrusion and is open on the top to upwardly separate the first rotating protrusion. The second rotational support may have a shape in which the second rotational support houses the second rotating protrusion and is open on the top thereof to upwardly separate the second rotating protrusion.

Since an ice maker or a refrigerator, according to exemplary embodiments of the present disclosure, may include an ice separating mechanism having a structure that totally twists an ice making tray, ice can be effectively separated.

Since the ice making tray may be more completely twisted, a more rigid ice separating structure can be achieved.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
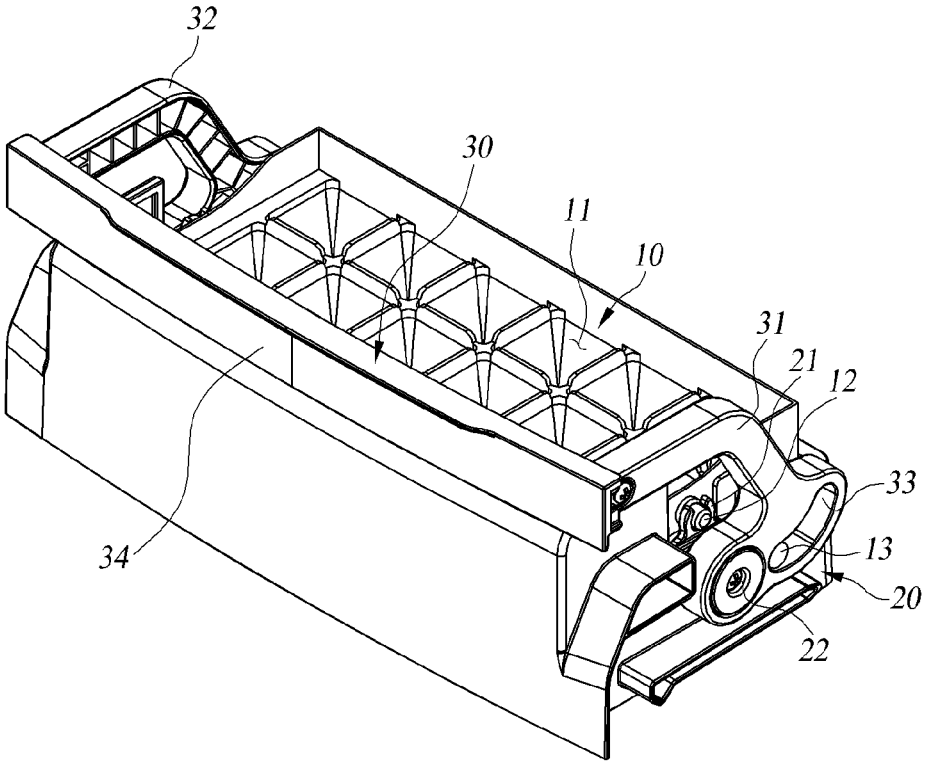
FIG. 1 illustrates an ice maker that can be installed in a refrigerator according to one or more exemplary embodiments of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which an exemplary embodiment of the disclosure can be easily understood by those skilled in the art. As those skilled in the art would realize, the described exemplary embodiments may be modified in various different ways, all without departing from the spirit or scope of the present disclosure and are not limited to exemplary embodiments described herein.

It is noted that the drawings are schematic and are not necessarily dimensionally illustrated. Relative sizes and proportions of parts in the drawings may be exaggerated or reduced in their sizes, and a predetermined size is just exemplary and not limiting. The same reference numerals designate the same structures, elements, or parts illustrated in the two or more drawings in order to exhibit the same or similar characteristics.

The present disclosure illustrates one or more embodiments in detail. As a result, various modifications of the drawings are expected. Accordingly, the exemplary embodiments are not limited to a specific form or the illustrated region, and for example, include modifications of form by manufacturing.

Figure 2:
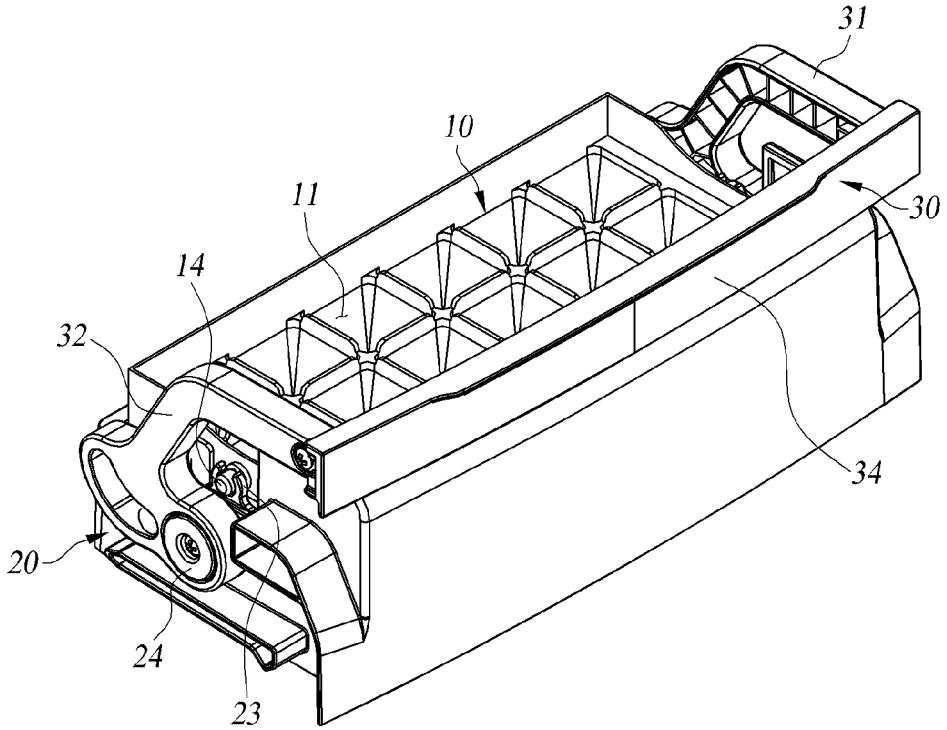
FIG. 2 illustrates an opposite view or shape of the exemplary ice maker of FIG. 1.

An ice maker and a refrigerator including the same according to exemplary embodiments of the present disclosure will be described through FIGS. 1 to 3.

First, an ice making tray 10 includes a plurality of partitioned ice making spaces 11. Each ice making space 11 is filled with water and subsequently refrigerated or frozen. As a result, ice is formed in the corresponding ice making space 11.

The ice making tray 10 has a quadrangular shape having a long axis and a short axis, and a first rotating protrusion 12 is formed on one wall along a long-axis direction and a second rotating protrusion 14 is formed on an opposite wall on the long-axis direction.

The first rotating protrusion 12 and the second rotating protrusion 14 are positioned substantially at the centers of the one wall and the other wall thereof.

An ice separating protrusion 13 is formed on one wall of ice making tray 10. The ice making protrusion 13 is positioned downwardly from or below first rotating protrusion 12 on the one wall, and protrudes or extends outwardly from the one wall.

In terms of a position, ice making protrusion 13 is positioned nearer to a rear side of ice making tray 10 and away from first rotating protrusion 12. The ice separating protrusion 13 is positioned lower than a bottom of ice making space 11, in ice making tray 10.

The ice separating protrusion 13 is formed only on one wall having the first rotating protrusion 12, and not on the other wall having the second rotating protrusion 14.

The ice making tray 10 is housed in a tray housing 20 with at least the sides thereof being rotatably supported.

To this end, a first rotational support 21 rotatably supporting the first rotating protrusion 12 is on a first side wall of tray housing 20, and a second rotational support 23 rotatably supporting the second rotating protrusion 14 is on a second side wall which is opposite to the first side wall.

The first rotational support 21 and the second rotational support 23 comprise circular seats on and/or in which the first rotating protrusion 12 and the second rotating protrusion 14 may be seated, respectively, and the tops thereof are open.

Since the tops of first rotational support 21 and second rotational support 23 holding the first rotating protrusion 12 and the second rotating protrusion 14 are open, ice making tray 10 may be separated or removed from the tray housing 20.

Although not illustrated, the tray housing 20 may provide a space for storing ice below the ice making tray 10. The tray housing 20 may include an ice box or container for storing ice therein.

The first side wall and the second side wall of tray housing 20 may include parts of which the ends are lower than corresponding side walls of ice making tray 10. The first rotational support 21 and the second rotational support 23 protrude or extend outwardly from the first side wall and the second side wall, respectively. The first rotational support 21 and the second rotational support 23 extend above a center point of the front or first side wall and the second side wall, respectively.

The first side wall of tray housing 20 has a cutout 25 which opens downwardly from the location of the first rotational support 21.

Figure 3:
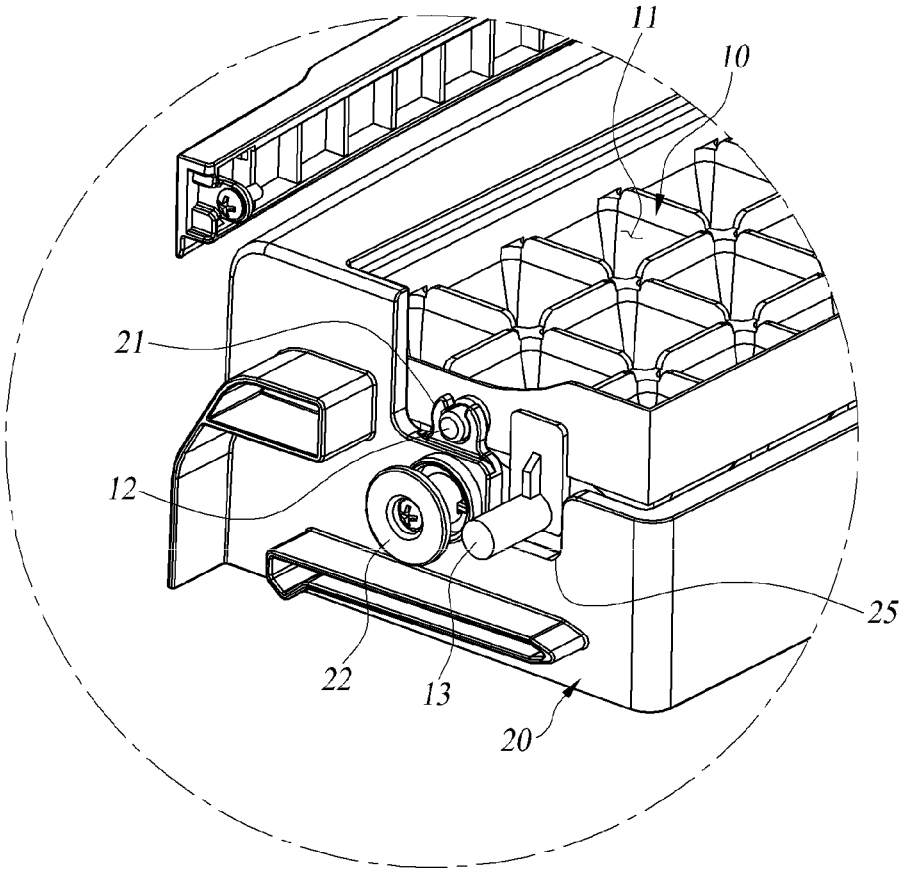
FIG. 3 is a partially enlarged diagram of a lever in the exemplary ice maker of FIGS. 1 and 2.

Cutout 25 on the first side wall of tray housing 20 is illustrated in a U shape in FIG. 3. Alternative shapes can be used for cutout 25 including, but not limited to, "V", curved, square, rectangle, etc.

The ice separating protrusion 13 of ice making tray 10 is positioned in cutout 25. When ice separating protrusion 13 rotates, as ice making tray 10 rotates, the tray housing 20 does not interfere with the rotation due to cutout 25.

Meanwhile, a first lever hinge 22 is included in the first side wall of tray housing 20, and a first lever 31 of an ice separating lever 30 is connected to first lever hinge 22. A second lever hinge 24 is included in the second side wall of tray housing 20, and a second lever 32 of ice separating lever 30 is connected to second lever hinge 24.

A groove 33 housing the ice separating protrusion 13 of ice making tray 10 is at a rear side of a part of or behind first lever 31 connected with first lever hinge 22.

The groove 33 forms a curve-shaped slot to allow rotation or additional rotation of ice separating protrusion 13 when ice making tray 10 rotates around first rotational support 21 and second rotational support 23.

The ice separating lever 30 includes a handle 34 in the front of ice making tray 10. First lever 31 and second lever 32 extend upwards from the front side of ice making tray 10, and are connected by handle 34 in front of ice making tray 10 when tray 10 is positioned in tray housing 20.

When the handle 34 is pulled forward, first lever 31 and second lever 32 rotate around first lever hinge 22 and second lever hinge 24, respectively. In this case, ice separating protrusion 13 of ice making tray 10, housed in groove 33 of first lever 31, is pushed and/or pulled by first lever 31 to rotate together.

The ice making tray 10 is rotatably supported on first rotational support 21 and second rotational support 23 of tray housing 20, and first lever 31 and second lever 32 are connected to first lever hinge 22 and second lever hinge 24 at lower positions thereof, respectively. As a result, a rotational center of ice making tray 10 and rotational centers of first and second levers 31 and 32 are different from each other in positions thereof. This relationship, along with the arc of the groove 33, may enable the tray 10 to rotate more than the handle 34 and levers 31 and 32.

When ice separating protrusion 13 is pushed and/or pulled by first lever 31, ice separating protrusion 13 moves in relation to groove 33 of first lever 31. As a result, ice making tray 10 is twisted. In one implementation, ice separating protrusion 13 moves along a portion or the entirety of groove 33 for added twisting and/or rotation (e.g., up to 180 degrees) of ice tray 10 about first rotational support 21 and second rotation support 23 for ice removal.

Ice made in ice making tray 10 is separated from ice making tray 10 through the twisting operation. That is, separation of the ice from tray 10 occurs when tray 10 twists. This may also be implemented with one end or corner of tray 10 hitting housing 20 before another end or corner.

In exemplary embodiments, ice making tray 10 is positioned between first lever 31 and second lever 32, wherein first lever 31 and second lever 32 are connected through handle 34 at the front side of ice making tray 10. Ice making tray 10 is twisted by first lever 31. First lever 31 is connected with second lever 32 through handle 34, and as a result, the first lever 31 produces a reaction to the twisting in second lever 32, thereby achieving more strong and rigid twisting.

The twisting operation acting on ice making tray 10 achieves more effective separation of ice from tray 10.

In exemplary embodiments, ice making tray 10, tray housing 20, first lever 31, and second lever 32 comprises or are made of a synthetic resin material to flexibly respond to the twisting, but the materials thereof are not limited thereto.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure will not limit the present disclosure. The scope of the present disclosure will be interpreted by the claims below, and it will be construed that all techniques within the scope equivalent thereto belong to the scope of the present disclosure.

What is claimed is:

1. A refrigerator, comprising:

an ice making tray providing a plurality of partitioned ice making spaces and including a first rotating protrusion formed on one wall and a second rotating protrusion formed on an opposite wall and an ice separating protrusion being positioned nearer to a rear side of ice making tray and away from first rotating protrusion on the one wall;

a tray housing including a first side wall having a first rotational support to allow the first rotating protrusion to rotate and a second side wall having a second rotational support to allow the second rotating protrusion to rotate;

a first rotatable lever connected to the first side wall of the tray housing and having a groove configured to house or hold the ice separating protrusion;

a second rotatable lever connected to the second side wall of the tray housing; and a handle in front of the ice making tray and connected to the first rotatable lever and the second rotatable lever, wherein the tray housing includes a first lever hinge connected with the first rotatable lever below the first rotational support on the first side wall, a second lever hinge connected with the second rotatable lever below the second rotational support on the second side wall, and the groove is behind the first lever hinge, wherein the first side wall and the second side wall of tray housing include parts of which the ends are lower than corresponding side walls of ice making tray, and the first rotational support and the second rotational support protrude or extend outwardly from the first side wall and the second side wall, respectively, and the first rotational support and the second rotational support extend above a center point of the front or first side wall and the second side wall, respectively, and wherein the first side wall of tray housing has a cutout which opens downwardly from the location of the first rotational support, and the ice separating protrusion of ice making tray is positioned in the cutout.

2. The refrigerator of claim 1, wherein the groove comprises a curved slot to allow the ice separating protrusion to rotate around the first rotational support.

3. The refrigerator of claim 1, wherein the ice separating protrusion extends downwardly from one side wall of the ice making tray and extends outwardly from the one side wall.

4. The refrigerator of claim 1, wherein the ice separating protrusion is behind the first rotational support.

5. The refrigerator of claim 1, wherein the ice making tray is between the first rotatable lever and the second rotatable lever, the first rotatable lever and the second rotatable lever extend in front of the ice making tray, and the handle connects the first rotatable lever and the second rotatable lever in front of the ice making tray.

* * * * *